US010676988B2

(12) United States Patent
Lin

(10) Patent No.: US 10,676,988 B2
(45) Date of Patent: Jun. 9, 2020

(54) WINDOW COVERING CONTROL APPARATUS

(71) Applicant: Whole Space Industries LTD, Taipei (TW)

(72) Inventor: Tzu-Yen Lin, Taipei (TW)

(73) Assignee: Whole Space Industries LTD., Taipei (TW)

( * ) Notice: Subject to any disclaimer, the term of this patent is extended or adjusted under 35 U.S.C. 154(b) by 74 days.

(21) Appl. No.: 15/709,996

(22) Filed: Sep. 20, 2017

(65) Prior Publication Data

US 2019/0085622 A1 Mar. 21, 2019

(51) Int. Cl.

| | |
|---|---|
| ***E06B 9/308*** | (2006.01) |
| ***E06B 9/322*** | (2006.01) |
| ***E06B 9/307*** | (2006.01) |

(52) U.S. Cl.

CPC ..... *E06B 9/322* (2013.01); *E06B 9/307* (2013.01); *E06B 9/308* (2013.01); *E06B 2009/3222* (2013.01)

(58) Field of Classification Search

CPC ..... E06B 9/322; E06B 9/308; E06B 9/307; E06B 9/266; E06B 9/305; E06B 9/306; E06B 2009/3222; E06B 2009/3225; E06B 9/303

See application file for complete search history.

(56) References Cited

U.S. PATENT DOCUMENTS

| | | | |
|---|---|---|---|
| 13,251 | A | 7/1855 | Bixler |
| 663,530 | A | 12/1900 | Wilson |
| 1,639,239 | A | 8/1927 | Trinkaus |
| 2,231,778 | A | 2/1941 | Swanson |
| 2,390,826 | A | 12/1945 | Cohn |
| 2,420,301 | A | 5/1947 | Cusumano |
| 2,580,253 | A | 12/1951 | Stuber et al. |
| 2,594,637 | A | 4/1952 | Gertzon |
| 3,333,905 | A | 8/1967 | Hennequin |
| 3,352,349 | A | 11/1967 | Hennequin |
| 3,809,143 | A | 5/1974 | Ipekgil |

(Continued)

FOREIGN PATENT DOCUMENTS

| | | |
|---|---|---|
| CA | 2555707 A1 | 2/2008 |
| CN | 205532186 U | 8/2016 |

(Continued)

OTHER PUBLICATIONS

U.S. Appl. No. 15/659,943, filed Jul. 26, 2017 for Slat Tilt Mechanism for Window Coverings.

(Continued)

*Primary Examiner* — Johnnie A. Shablack

(74) *Attorney, Agent, or Firm* — Buchanan Ingersoll & Rooney PC

(57) ABSTRACT

A window covering includes a first rail and a plurality tiltable slats. The slats can be connected to a slat tilt control mechanism positioned within the first rail. The slat tilt control mechanism can be configured to tilt the slats to a tilted position (e.g. a closed position, or orientation) during the lifting or lowering of the window covering. The slat tilt control mechanism can also be configured to tilt the slats from a tilted position to an open position, or horizontal orientation, during the lifting or lowering of the window covering material.

20 Claims, 6 Drawing Sheets

(56) References Cited

U.S. PATENT DOCUMENTS 3,835,911 A * 9/1974 Horst ..... E06B 9/322 160/168.1 R
3,921,695 A 11/1975 Debs
4,333,510 A 6/1982 Fox
4,507,831 A 4/1985 McClure
4,522,245 A 6/1985 Anderson
4,697,630 A 10/1987 Rude
4,917,168 A * 4/1990 Chen ..... E06B 9/307 160/176.1 R
4,955,248 A 9/1990 Lindstrom
5,002,113 A 3/1991 Georgopoulos
5,092,387 A 3/1992 King et al.
5,103,888 A * 4/1992 Nakamura ..... E06B 9/308 160/171
5,186,229 A 2/1993 Hsu
5,228,491 A * 7/1993 Rude ..... E06B 9/307 160/168.1 R
5,297,608 A * 3/1994 Rap ..... E06B 9/307 160/177 R
5,396,945 A 3/1995 Meyer
5,482,100 A 1/1996 Kuhar
5,725,040 A * 3/1998 Domel ..... E06B 9/306 160/170
5,908,062 A * 6/1999 Fun ..... E06B 9/30 160/170
6,283,192 B1 9/2001 Toti
6,308,764 B1 10/2001 Lin
6,325,133 B1 12/2001 Lin
6,571,853 B1 6/2003 Ciuca et al.
6,601,635 B2 8/2003 Ciuca et al.
6,644,372 B2 11/2003 Judkins
6,644,373 B2 11/2003 Palmer
6,761,203 B1 7/2004 Huang
6,978,822 B2 12/2005 Schoonen
7,025,107 B2 4/2006 Ciuca
7,093,644 B2 8/2006 Strand
7,117,919 B2 10/2006 Judkins
7,137,430 B2 * 11/2006 Fraczek ..... E06B 9/303 160/170
7,143,802 B2 12/2006 Strand et al.
7,159,636 B2 1/2007 Liang
7,168,476 B2 1/2007 Chen
7,178,577 B2 2/2007 Lin
7,210,646 B2 * 5/2007 Hsu ..... B65H 75/48 160/170
7,219,710 B2 5/2007 Cheng
7,228,797 B1 6/2007 Hillman et al.
7,287,569 B2 10/2007 Lin
7,311,133 B2 12/2007 Anderson et al.
7,389,956 B2 * 6/2008 Hung ..... E06B 9/322 160/170
7,398,815 B2 7/2008 Liang
7,503,370 B2 3/2009 Ciuca et al.
7,624,785 B2 12/2009 Yu et al.
7,654,300 B2 * 2/2010 Chigusa ..... E06B 9/322 160/170
7,654,301 B2 2/2010 Krab et al.
7,664,748 B2 2/2010 Harrity
7,721,783 B2 5/2010 Colson et al.
7,832,453 B2 * 11/2010 Lin ..... E06B 9/307 160/168.1 R
7,866,367 B2 1/2011 Liang et al.
7,950,437 B2 5/2011 Lin
7,984,745 B2 7/2011 Wen et al.
8,002,012 B2 8/2011 Cheng
8,079,398 B2 12/2011 Tsukamoto
8,087,445 B2 1/2012 DeWard et al.
8,251,120 B2 8/2012 Chen
8,281,843 B2 10/2012 Yu et al.
8,381,793 B2 * 2/2013 Krab ..... E06B 9/307 160/171
8,708,023 B2 4/2014 Wu
8,770,257 B2 * 7/2014 Kao ..... E06B 9/322 160/174 R
8,820,385 B2 * 9/2014 Wu ..... E06B 9/322 160/170
8,910,696 B2 12/2014 Wen et al.
8,939,190 B2 1/2015 Mullet et al.
9,045,934 B1 6/2015 Lynch et al.
9,078,537 B2 7/2015 Lee
9,091,115 B2 7/2015 Mullet et al.
9,149,143 B2 10/2015 Vestal
9,157,273 B2 * 10/2015 Dekker ..... E06B 9/322
9,181,751 B1 11/2015 Hong
9,217,282 B2 12/2015 Defenbaugh et al.
9,222,302 B2 * 12/2015 Black ..... E06B 9/303
9,246,619 B2 1/2016 Hole et al.
9,316,051 B2 4/2016 Toti
9,328,554 B2 5/2016 Toti
9,376,859 B1 6/2016 Deward et al.
9,410,366 B2 8/2016 Kwak
9,903,157 B2 * 2/2018 Dekker ..... E06B 9/322
9,957,750 B2 * 5/2018 Lin ..... E06B 9/262
10,156,092 B2 * 12/2018 Steenbergen ..... E06B 9/307
10,208,534 B2 * 2/2019 Dekker ..... E06B 9/322
2002/0020506 A1 * 2/2002 Dekker ..... E06B 9/307 160/115
2003/0178155 A1 * 9/2003 Fraczek ..... E06B 9/303 160/170
2004/0154758 A1 8/2004 Cheng et al.
2006/0042763 A1 * 3/2006 Le Ru ..... E06B 9/308 160/171
2007/0051477 A1 3/2007 Fraser et al.
2007/0056692 A1 3/2007 Nien et al.
2008/0083512 A1 * 4/2008 Hsu ..... E06B 9/322 160/170
2008/0210387 A1 * 9/2008 Yang ..... E06B 9/322 160/168.1 V
2009/0108116 A1 4/2009 Chang
2010/0126673 A1 5/2010 Lin
2010/0126678 A1 5/2010 Lin
2010/0270457 A1 * 10/2010 Ko ..... E06B 9/322 248/674
2011/0024065 A1 2/2011 Lin
2011/0061823 A1 3/2011 Lin
2011/0198044 A1 8/2011 Lin
2011/0247761 A1 10/2011 Lin
2012/0160426 A1 6/2012 Lin
2012/0175067 A1 7/2012 Lin
2012/0211180 A1 8/2012 Lin
2012/0227910 A1 9/2012 Lin
2012/0305199 A1 12/2012 Lin
2013/0048233 A1 2/2013 Lin
2013/0056161 A1 * 3/2013 Lin ..... E06B 9/264 160/84.02
2013/0075045 A1 3/2013 Lin
2013/0091968 A1 4/2013 Lin
2013/0126105 A1 5/2013 Lin
2013/0220561 A1 8/2013 Yu et al.
2013/0248125 A1 9/2013 Lin
2014/0083631 A1 3/2014 Huang
2015/0129142 A1 * 5/2015 Huang ..... E06B 9/262 160/370
2015/0136336 A1 5/2015 Huang
2015/0315842 A1 11/2015 Hong
2016/0069129 A1 3/2016 Lin
2016/0230455 A1 * 8/2016 Dekker ..... E06B 9/322
2016/0237739 A1 8/2016 Lin
2017/0016274 A1 * 1/2017 Zheng ..... E06B 9/304
2017/0218700 A1 8/2017 Lin
2017/0218701 A1 8/2017 Lin
2017/0218702 A1 8/2017 Lin
2017/0362887 A1 * 12/2017 Lin ..... E06B 9/303
2018/0000273 A1 * 1/2018 Wu ..... E06B 9/322
2018/0163463 A1 * 6/2018 Lin ..... E06B 9/262
2018/0328108 A1 * 11/2018 Chou ..... E06B 9/42
2019/0032400 A1 * 1/2019 Lin ..... E06B 9/307

(56) References Cited

U.S. PATENT DOCUMENTS

| | | | | |
|---|---|---|---|---|
| 2019/0048655 | A1* | 2/2019 | Lin | E06B 9/305 |
| 2019/0085622 | A1* | 3/2019 | Lin | E06B 9/322 |

FOREIGN PATENT DOCUMENTS

| | | | |
|---|---|---|---|
| DE | 202007002543 | U1 | 8/2007 |
| EP | 1087095 | A1 | 3/2001 |
| FR | 2955606 | A1 | 7/2011 |
| GB | 1081976 | | 9/1967 |

OTHER PUBLICATIONS

U.S. Appl. No. 15/185,400, filed Jun. 17, 2016 for Slat Control Mechanism for Blinds.
U.S. Appl. No. 15/177,575, filed Jun. 9, 2016 for Window Covering Positional Adjustment Apparatus.
U.S. Appl. No. 15/672,442, filed Aug. 9, 2017 for Window Covering Control Apparatus.
Search Report from the European Patent Office for European Patent Application No. 17207347.0 dated Aug. 28, 2018.

* cited by examiner

WINDOW COVERING CONTROL APPARATUS

FIELD OF INVENTION

The present innovation relates to window coverings. For example, the present innovation relates to window coverings, ladder cord control mechanisms, and methods of utilizing such window coverings and/or mechanisms.

BACKGROUND OF THE INVENTION

Window coverings can be configured so that a material is moveable to partially or fully cover a window. Window coverings such as venetian blinds can utilize slats that are tiltable. Other types of window coverings can include other types of window covering material (e.g. cordless cellular shades, cordless Roman shades, etc.). Examples of such window coverings can be appreciated from U.S. Pat. Nos. 9,410,366, 9,376,859, 9,328,554, 9,316,051, 9,246,619, 9,217,282, 9,181,751, 9,149,143, 9,091,115, 9,078,537, 9,045,934, 8,939,190, 8,910,696, 8,708,023, 8,281,843, 8,251,120, 8,087,445, 8,079,398, 8,002,012, 7,984,745, 7,950,437, 7,866,367, 7,721,783, 7,654,301, 7,664,748, 7,624,785, 7,503,370, 7,398,815, 7,311,133, 7,287,569, 7,228,797, 7,219,710, 7,178,577, 7,168,476, 7,159,636, 7,143,802, 7,117,919, 7,093,644, 7,025,107, 6,978,822, 6,761,203, 6,644,373, 6,644,372, 6,601,635, 6,571,853, 6,325,133, 6,308,764, 6,283,192, 5,482,100, 5,396,945, 5,186,229, 5,092,387, 5,002,113, 4,955,248, 4,522,245, 4,507,831, 3,921,695, 2,580,253, 2,420.301, and 13,251 and U.S. Patent Application Publication Nos. 2015/0136336, 2015/0315842, 2014/0083631, 2013/0220561, 2013/0048233, 2013/0248125, 2013/0126105, 2013/0091968, 2013/0075045, 2012/0305199, 2012/0227910, 2012/0211180, 2012/0175067, 2012/0160426, 2011/0247761, 2011/0198044, 2011/0024065, 2011/0061823, 2010/0126678, 2010/0126673, 2007/0056692, and 2007/0051477. Other examples of window coverings can be appreciated from co-pending U.S. patent application Ser. Nos. 15/672,442, 15/659,943, 15/185,400, and 15/177,575.

Window coverings that include slats, such as venetian blinds, often need a tilt wand to effect tilting of the slats. Such window coverings can often include operator cords that extend from a cord lock and also include a tilt wand. The tilt wand often has to be rotated by a user to effect tilting of the slats. The cord lock is often utilized to control the vertical height adjustment of the blind.

SUMMARY OF THE INVENTION

I have determined that the bifurcation of tilting and height adjustment controls can be a source of annoyance to a user. Further, such a design can require exposed elements that are positioned external to and adjacent the slats that a consumer may deem to be unattractive (e.g. the wand and exposed operator cords). I have determined that a new window covering design is needed that can permit effective height adjustment of window covering material while also permitting the tilting of slats so that exposed control elements do not have to be utilized in window coverings. I have also developed a new window covering design, a new slat tilt mechanism, and methods of making and using the same that can be configured to provide such features. In some embodiments, the window covering can be configured as a cordless window covering that does not have any exposed operator cord and also does not include any exposed tilt wand or other exposed slat tilting control element. In other embodiments, the window covering can include exposed lift cords, an exposed operator cord and/or operator wand.

Embodiments of my window covering are provided in which a window covering can include a first rail and window covering material comprising a plurality of slats being moveable relative to the first rail. A lift cord control mechanism can be positioned in the first rail. The lift cord control mechanism can include a drive shaft that extends within the first rail. A first lift cord pulley can be connected to the drive shaft such that rotation of the drive shaft in a first rotational direction causes the first lift cord pulley to rotate in the first rotational direction and rotation of the first lift cord pulley in a second rotational direction that is opposite the first rotational direction causes the drive shaft to rotate in the second rotational direction. A first ladder cord connector can be connected to a first end of the first lift cord pulley to define a first slot between the first ladder cord connector and the first lift cord pulley. A first ladder can include a front rail, a rear rail, and rungs extending between the front and rear rails. Each of the rungs of the first ladder can support a respective one of the slats (e.g. at least partially support a slat or support a first end or side of a slat). The front rail can be moveable relative to the rear rail to adjust an orientation of the rungs between tilted orientations and a horizontal orientation. An upper end of the first ladder can be defined by a connection between an upper end of the front rail and an upper end of the rear rail. The upper end of the first ladder can be positioned in the first slot between the first ladder cord connector and the first lift cord pulley so that rotation of the drive shaft in the first rotational direction moves the first ladder so that the rungs are moveable into a first tilted orientation (e.g. inclined or declined orientation) for tilting of the slats and rotation of the drive shaft in the second rotational direction moves the first ladder so that the rungs are moveable into a second tilted orientation for tilting of the slats (e.g. an inclined or declined orientation that is tilted opposite the tilting of the first tilted orientation). A first lift cord can extend from the first lift cord pulley to a position adjacent a bottom-most slat of the slats supported by a bottommost rung of the rungs of the first ladder. The first lift cord can be connected to the first lift cord pulley such that rotation of the first lift cord pulley in the first rotational direction winds the first lift cord about the first lift cord pulley to facilitate retraction of the window covering material and rotation of the first lift cord pulley in the second rotational direction unwinds the first lift cord from the first lift cord pulley to facilitate extension of the window covering material.

Embodiments of the window covering can be configured so that the first rail is a headrail or the middle rail of a top down bottom up shade. A second rail can also be included as a bottom rail. the second rail can be connected adjacent to the bottom-most rung and the bottom-most slat via a connection to one or more lift cords or attachment to the bottom-most slat or attachment to one or more ladders that can extend form the first rail.

The drive shaft can be configured to extend through the first lift cord pulley and the first ladder cord pulley. For example, the drive shaft can be positioned in the first rail so that it passes through a central channel of the first lift cord pulley that is aligned with a channel defined in the first ladder cord connector. The drive shaft can extend through the central channel of the first lift cord pulley and also extend through the channel defined in the first ladder cord connector. These channels can be configured so that the drive shaft is interlocked to the first lift cord pulley and the first ladder cord connector (e.g. the drive shaft has a cross-sectional shape that mates with the cross-sectional shape of the channels).

Embodiments of the window covering can include other features. For instance, the window covering can also include a first end connector attached to a second end of the first lift cord pulley. The first lift cord can be collectable on a body of the first lift cord pulley between the first end connector and the first ladder cord connector via rotation of the first lift cord pulley in the first rotational direction (e.g. be wound upon the body of the first lift cord pulley via rotation in the first rotational direction). The first lift cord can also be uncollectable, or unwindable from the body of the first lift cord pulley between the first end connector and the first ladder cord connector via rotation of the first lift cord pulley in the second rotational direction (e.g. be unwound from the body of the first lift cord pulley via rotation in the second rotational direction). The first rotational direction can be clockwise and the second rotational direction can be counterclockwise in some embodiments. In other embodiments, the first rotational direction can be counterclockwise and the second rotational direction can be clockwise.

The lift cord control mechanism of the window covering can include a number of different mechanisms. In some embodiments, the lift cord control mechanism can include at least one spring motor unit. In other embodiments, the lift cord control mechanism could be a loop cord drive, an electric motor, or another type of lift cord control mechanism. For instance, the lift cord control mechanism can include a first spring motor that includes a first spring motor pulley, a second spring motor pulley and a spring extending between the first spring motor pulley and the second spring motor pulley. The drive shaft can be connected to the first spring motor pulley. The spring can be configured to bias the first spring motor pulley to rotate in the first rotational direction.

The window covering can also include mounting elements positioned in the first rail adjacent the first lift cord pulley. Each mounting element can include at least one friction inducing member for contacting a lift cord. For instance, a mounting element can include a first friction inducing member attached to the mounting element so that the first friction inducing member is not rotatable and the first lift cord contacts the first friction inducing member. The first lift cord can be routed along the first friction inducing member such that the first lift cord defines at least one full encirclement about the friction inducting member.

A method for adjusting a window covering is also provided. The method can include providing a window covering such as an embodiment of a window covering disclosed herein. Such a window covering can include, for example, a first rail; window covering material comprising a plurality of slats being moveable relative to the first rail, and a lift cord control mechanism positioned in the first rail. The lift cord control mechanism can have a drive shaft that extends within the first rail. The window covering can also include a first lift cord pulley connected to the drive shaft such that rotation of the drive shaft in a first rotational direction causes the first lift cord pulley to rotate in the first rotational direction and rotation of the first lift cord pulley in a second rotational direction that is opposite the first rotational direction causes the drive shaft to rotate in the second rotational direction, a first ladder cord connector connected to a first end of the first lift cord pulley to define a first slot between the first ladder cord connector and the first lift cord pulley, and a first ladder having a front rail, a rear rail, and rungs extending between the front rail and the rear rail. Each of the rungs of the first ladder can support a respective one of the slats. The front rail can be moveable relative to the rear rail to adjust an orientation of the rungs between tilted orientations and a horizontal orientation. An upper end of the first ladder can be defined by a connection between an upper end of the front rail and an upper end of the rear rail. The upper end of the first ladder can be positioned in the first slot between the first ladder cord connector and the first lift cord pulley so that rotation of the drive shaft in the first rotational direction moves the first ladder so that the rungs are moveable into a first tilted orientation for tilting of the slats and rotation of the drive shaft in the second rotational direction moves the first ladder so that the rungs are moveable into a second tilted orientation for tilting of the slats. A first lift cord can extend from the first lift cord pulley to a positioned adjacent a bottom-most slat of the slats supported by a bottommost rung of the rungs of the first ladder. The first lift cord can be connected to the first lift cord pulley such that rotation of the first lift cord pulley in the first rotational direction winds the first lift cord about the first lift cord pulley to facilitate retraction of the window covering material and rotation of the first lift cord pulley in the second rotational direction unwinds the first lift cord from the first lift cord pulley to facilitate extension of the window covering material. The method can also include providing a force to extend the window covering material so that the first lift cord is unwound from the first lift cord pulley and the first lift cord pulley rotates in the second rotational direction so that the drive shaft rotates in the second rotational direction and the rungs of the ladder are tilted so that the rungs are in the second tilted orientation and, after the providing of the force to extend the window covering material, providing a force to retract the window covering material until the rungs are in the horizontal orientation.

In some embodiments of the method, the force that is provided to retract the window covering material can be a lifting force and the force that is provided to extend the window covering material can be a lowering force. The window covering material can be pulled to provide the force to extend the window covering material and the window covering material can be pushed to provide the force to retract the window covering material in some embodiments of the method. A spring motor of the lift cord control mechanism can rotate the drive shaft to rotate in the first rotational direction in response to the force that is provided to retract the window covering material. The rotation of the drive shaft in the first rotational direction can cause the lift cord pulley to rotate in the first rotational direction to retract the window covering material.

Other embodiments of my method can include other embodiments of a window covering. Such an embodiment can include an embodiment of the window covering that includes a first rail, window covering material comprising a plurality of slats being moveable relative to the first rail, a second rail below the window covering material, a lift cord control mechanism positioned in the first rail that includes a rotatable drive shaft within the first rail, a first lift cord pulley connected to the drive shaft such that rotation of the drive shaft in a first rotational direction causes the first lift cord pulley to rotate in the first rotational direction and rotation of the first lift cord pulley in a second rotational direction that is opposite the first rotational direction causes the drive shaft to rotate in the second rotational direction, a first ladder cord connector connected to a first end of the first lift cord pulley to define a first slot between the first ladder cord connector and the first lift cord pulley, a first ladder having a front rail, a rear rail, and rungs extending between the front rail and the rear rail where each of the rungs of the first ladder support a respective one of the slats adjacent a first side of the slats, the front rail is moveable relative to the rear rail to adjust an orientation of the rungs between tilted orientations and a horizontal orientation, and an upper end of the first ladder is defined by a connection between an upper end of the front rail and an upper end of the rear rail. The upper end of the first ladder can be positioned in the first slot between the first ladder cord connector and the first lift cord pulley so that rotation of the drive shaft in the first rotational direction moves the first ladder so that the rungs are moveable into a first tilted orientation for tilting of the slats and rotation of the drive shaft in the second rotational direction moves the first ladder so that the rungs are moveable into a second tilted orientation for tilting of the slats. A first lift cord can extend from the first lift cord pulley to a position adjacent a bottom-most slat of the slats supported by a bottommost rung of the rungs of the first ladder. The first lift cord can be connected to the first lift cord pulley such that rotation of the first lift cord pulley in the first rotational direction winds the first lift cord about the first lift cord pulley to facilitate retraction of the window covering material and rotation of the first lift cord pulley in the second rotational direction unwinds the first lift cord from the first lift cord pulley to facilitate extension of the window covering material. A second lift cord pulley can be connected to the drive shaft such that rotation of the drive shaft in a first rotational direction causes the second lift cord pulley to rotate in the first rotational direction and rotation of the second lift cord pulley in a second rotational direction that is opposite the first rotational direction causes the drive shaft to rotate in the second rotational direction. A second ladder cord connector can be connected to a first end of the second lift cord pulley to define a second slot between the second ladder cord connector and the second lift cord pulley. A second ladder can have a front rail, a rear rail, and rungs extending between front and rear rails where each of the rungs of the second ladder support a respective one of the slats adjacent a second side of the slats. The front rail can be moveable relative to the rear rail to adjust an orientation of the rungs between tilted orientations and a horizontal orientation. An upper end of the second ladder can be defined by a connection between an upper end of the front rail and an upper end of the rear rail of the second ladder. The upper end of the second ladder being positioned in the second slot between the second ladder cord connector and the second lift cord pulley so that rotation of the drive shaft in the first rotational direction moves the second ladder so that the rungs are moveable into a first tilted orientation for tilting of the slats and rotation of the drive shaft in the second rotational direction moves the second ladder so that the rungs are moveable into a second tilted orientation for tilting of the slats. A second lift cord can extend from the second lift cord pulley to a positioned adjacent a bottom-most slat of the slats supported by a bottom-most rung of the rungs of the second ladder. The second lift cord can be connected to the second lift cord pulley such that rotation of the second lift cord pulley in the first rotational direction winds the second lift cord about the second lift cord pulley to facilitate retraction of the window covering material and rotation of the second lift cord pulley in the second rotational direction unwinds the second lift cord from the second lift cord pulley to facilitate extension of the window covering material.

In some embodiments, the window covering can also include a first mounting element positioned in the first rail adjacent the first lift cord pulley, a first friction inducing member attached to the first mounting element so that the first friction inducing member is not rotatable and is positioned below the first lift cord pulley such that the first lift cord contacts the first friction inducing member. A second mounting element can also be positioned in the first rail adjacent the second lift cord pulley. A second friction inducing member can be attached to the second mounting element so that the second friction inducing member is not rotatable and is positioned below the second lift cord pulley such that the second lift cord contacts the second friction inducing member. The first lift cord can be routed along the first friction inducing member such that the first lift cord defines at least one full encirclement about the first friction inducting member; and the second lift cord can be routed along the second friction inducing member such that the second lift cord defines at least one full encirclement about the second friction inducting member. Use of one or more encirclements can be utilized to induce a desired amount of friction during retraction or extension of the window covering material. The first mounting element can be configured to receive the first lift cord pulley and the first ladder cord connector and the second mounting element can be configured to receive the second lift cord pulley and the second ladder cord connector. The first and second mounting elements may be spaced apart from each other within the first rail so that the first and second lift cord pulleys are also spaced apart from each other. The first and second lift cord pulleys can be positioned such that the first and second ladder cord are each positioned closer to a center part of the first rail than the first and second lift cord pulleys or can be positioned so that the first and second ladder cord connectors are each positioned farther from the center part of the first rail than the first and second lift cord pulleys.

Other details, objects, and advantages of the window covering, window covering positional adjustment mechanism, and methods of making and using the same will become apparent as the following description of certain exemplary embodiments thereof proceeds.

BRIEF DESCRIPTION OF THE DRAWINGS

Exemplary embodiments of the window covering, a slat tilt mechanism, and methods of making and using the same are shown in the accompanying drawings. It should be understood that like reference numbers used in the drawings may identify like components.

DETAILED DESCRIPTION OF EXEMPLARY EMBODIMENTS

Figure 1:
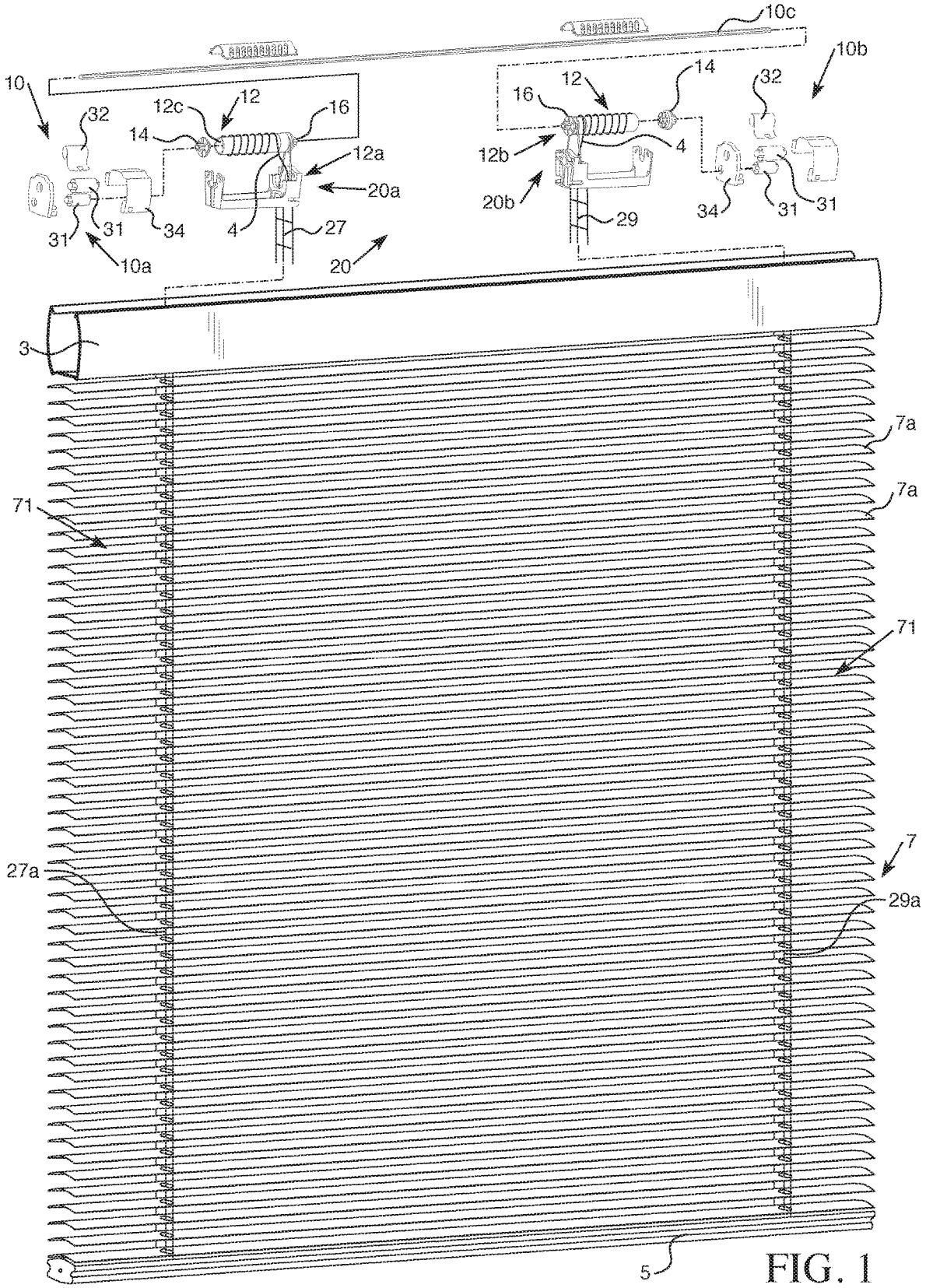
FIG. 1 is an exploded view of a first exemplary embodiment of my window covering in an extended position in which the slats are in an open position.
Figure 2:
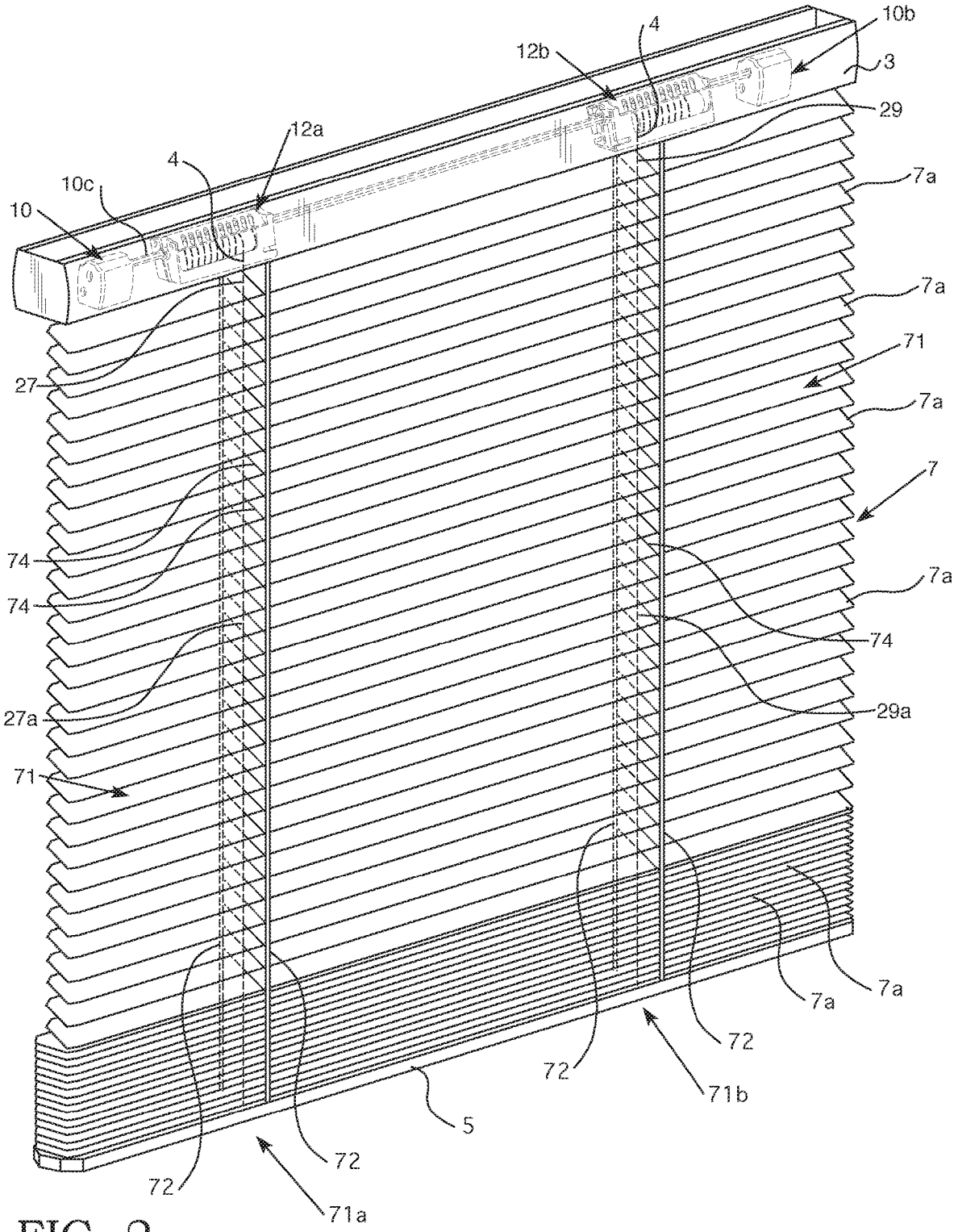
FIG. 2 is a perspective view of the first exemplary embodiment of my window covering in a partially retracted position in which the slats are in a tilted position.
Figure 3:
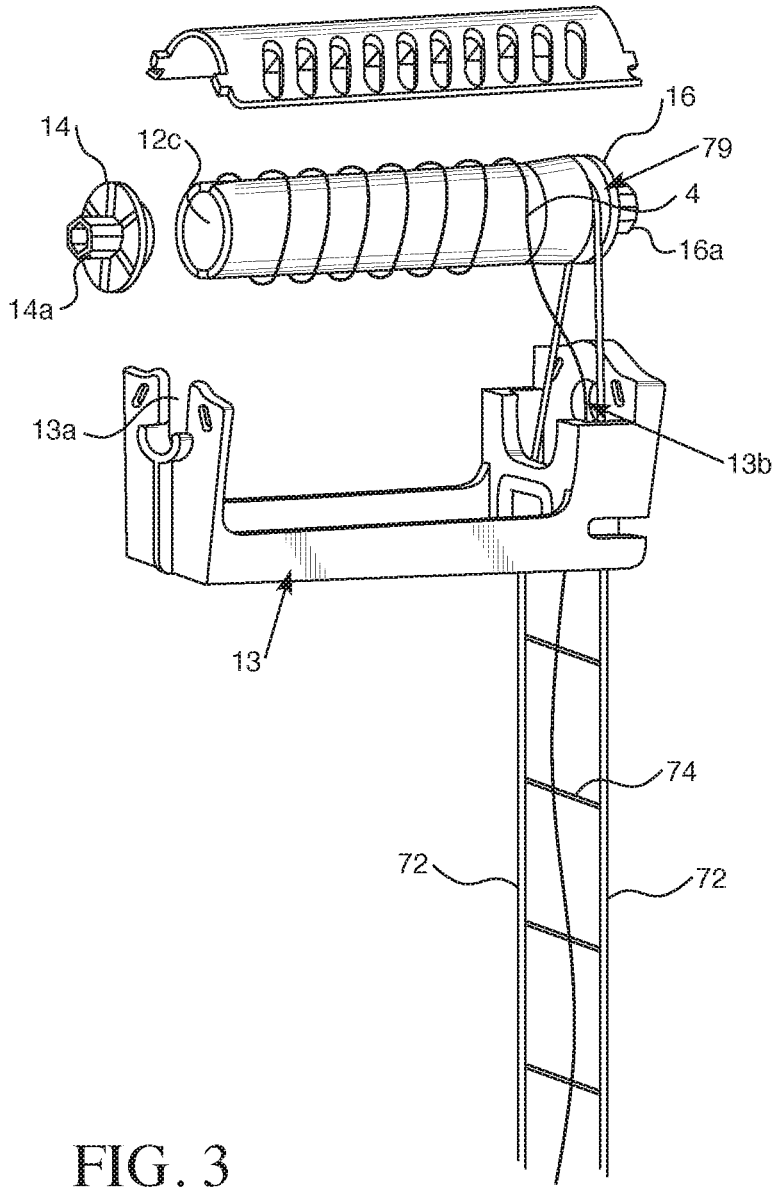
FIG. 3 is an exploded view of a first exemplary embodiment of a ladder tilt control mechanism that is included in the first exemplary embodiment of my window covering shown in FIGS. 1-2 that illustrates exemplary components of the lift cord control mechanism of this first exemplary embodiment for supporting the slats and controlling the orientation of the slats (e.g. tilted or untilted).
Figure 4:
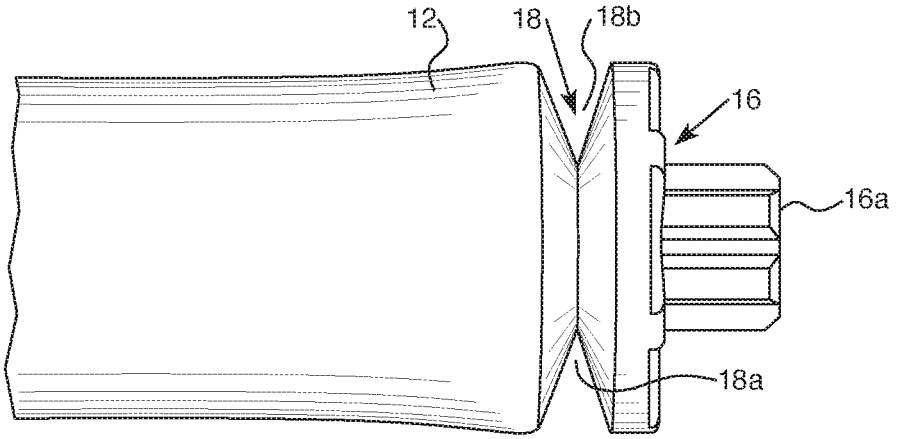
FIG. 4 is an enlarged fragmentary view of the first exemplary embodiment of the ladder tilt control mechanism of the first exemplary embodiment of my window covering to illustrate a slot configured to retain an upper end portion of a ladder cord.
Figure 5:
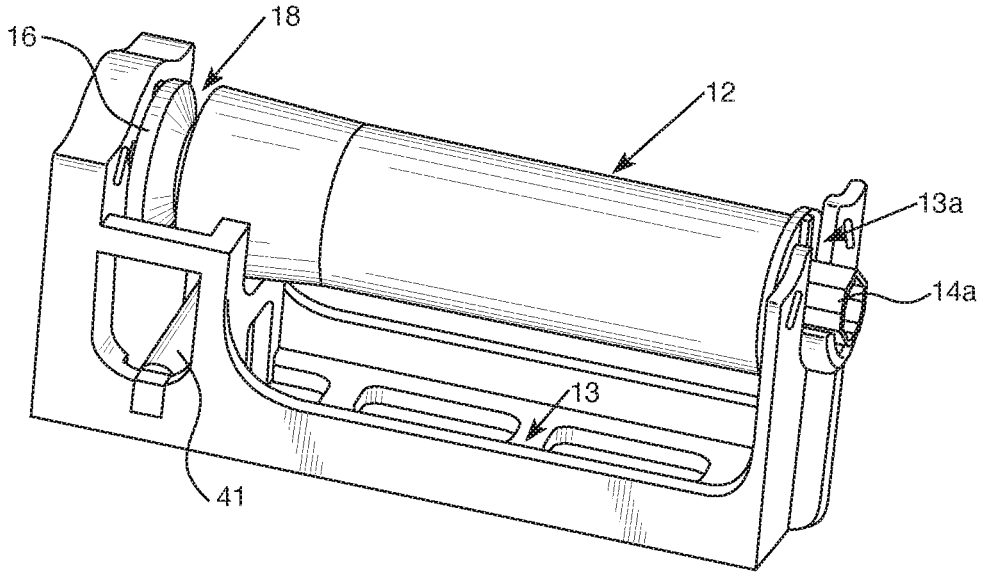
FIG. 5 is a perspective view of the first exemplary embodiment of a ladder tilt control mechanism that is included in the first exemplary embodiment of my window covering.
Figure 6:
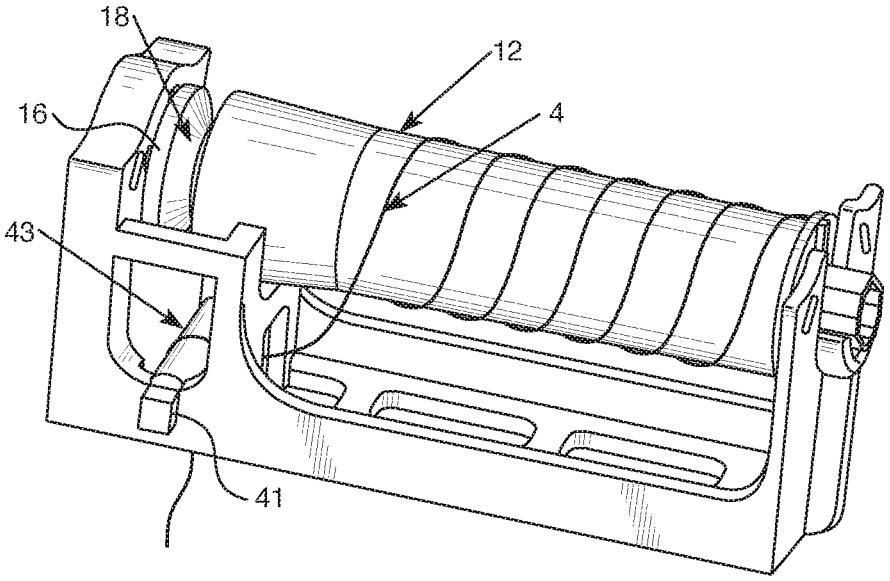
FIG. 6 is a perspective view of the first exemplary embodiment of a ladder tilt control mechanism that is included in the first exemplary embodiment of my window covering with a lift cord wound thereon to illustrate how a lift cord is routable adjacent a ladder cord via the ladder tilt control mechanism.
Figure 7:
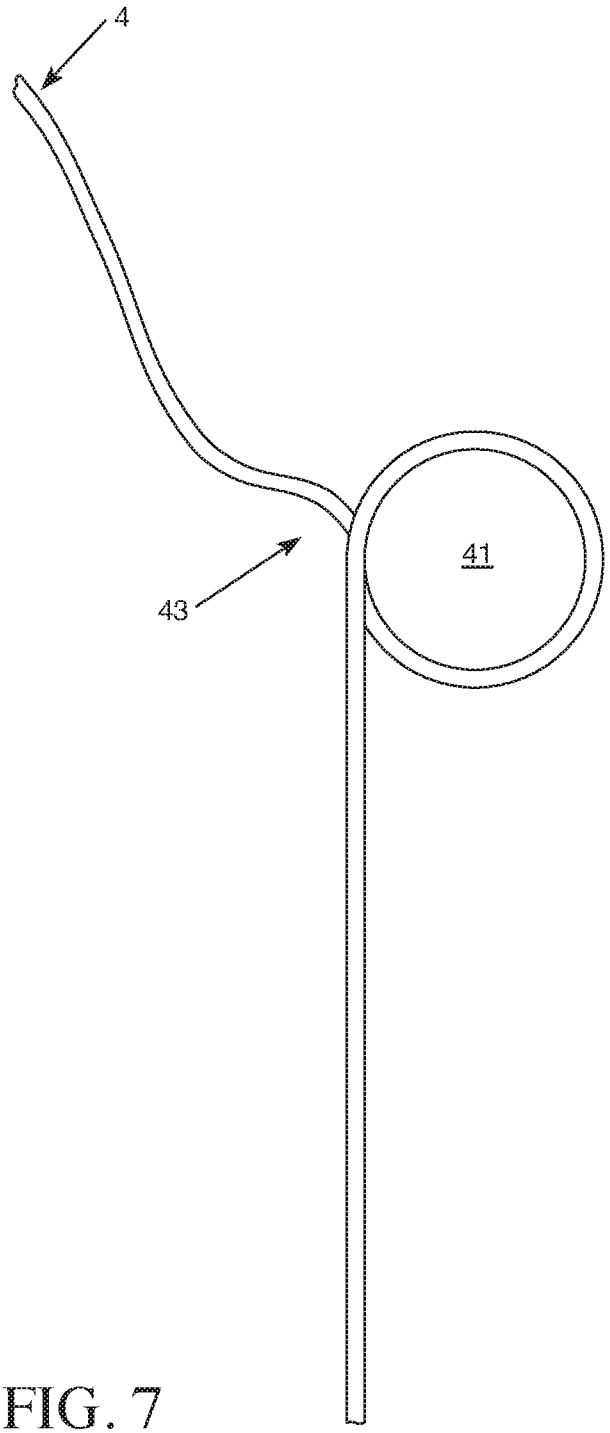
FIG. 7 is a schematic view illustrating an exemplary lift cord routing that can be provided by the first exemplary embodiment of a ladder tilt control mechanism that is included in the first exemplary embodiment of my window covering.
Figure 8:
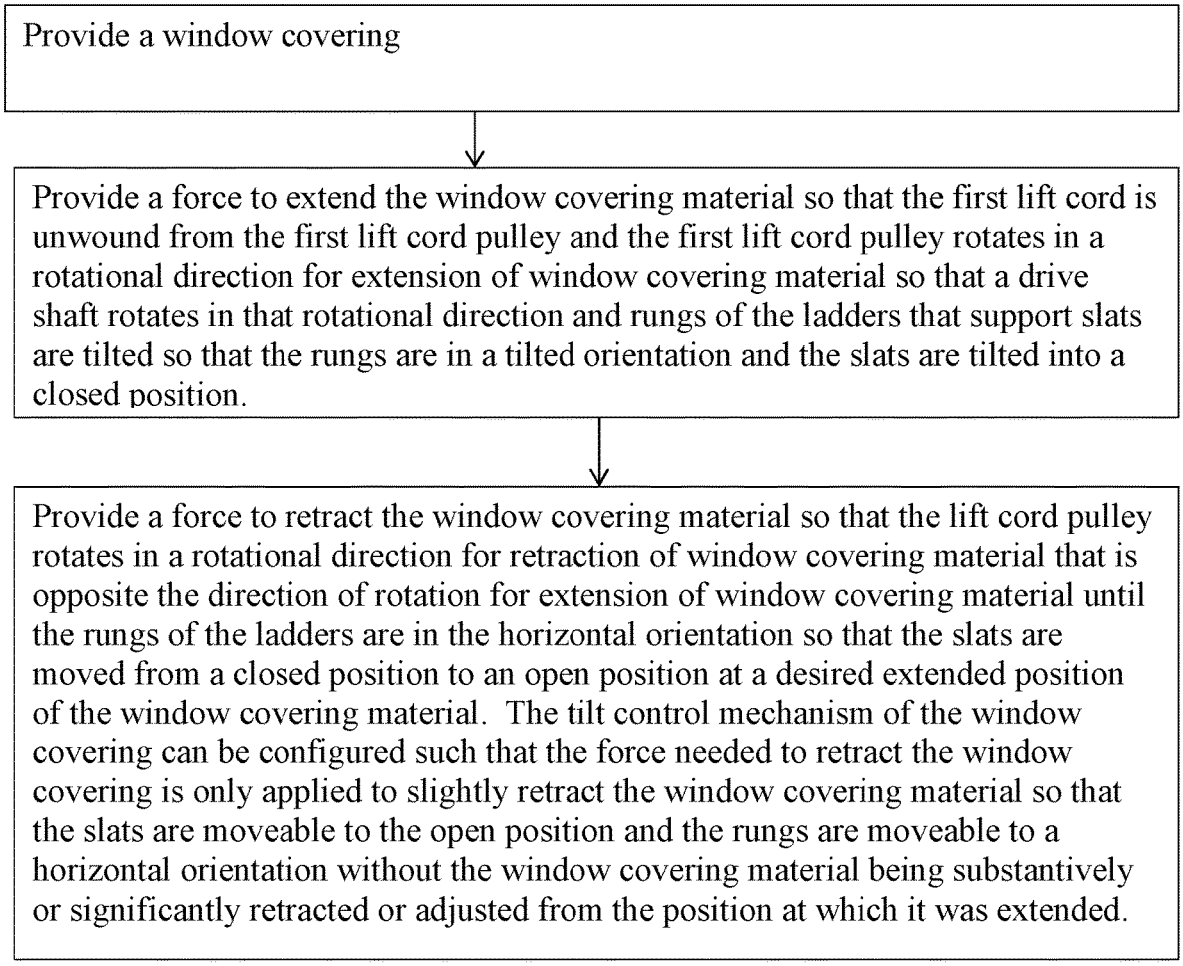
FIG. 8 is a flow chart illustrating an exemplary method of using a window covering.

As can be appreciated from FIGS. 1-8, embodiments of the window covering can include a height adjustment mechanism for controlling the raising and lowering of window covering material. Embodiments of the window covering can be configured to permit the window covering material to be raised and lowered without use of lift cords passing through a cord lock and/or without use of any exposed operator cord while also not utilizing any type of exposed slat tilt control element (e.g. a tilt wand). Other embodiments may include one or more exposed cords, such as exposed operator cords or exposed lift cords that may pass out of a cord lock.

Embodiments of the window covering 1 can include a first rail 3, a second rail 5, and window covering material 7 that is moveably attached to the first rail 3. In some embodiments, the first rail 3 can be configured as a headrail and the second rail 5 can be configured as a bottom rail. In embodiments of the window covering in which the window covering is configured as a top down bottom up shade, there may also be a third rail positioned above the first rail 3 such that the first rail is an intermediate rail and the upper third rail is a headrail.

The second rail 5 can be connected to the window covering material 7 and/or may be coupled to the first rail 3 such that the window covering material 7 and second rail 5 are moveable relative to the first rail 3. The window covering material 7 can be moveable between a fully lowered, or fully extended first position, and a fully retracted, or fully raised second position. The window covering material 7 can be connected to the first rail 3 via one or more lift cords 4 that are coupled to a lift cord control mechanism 10 so that the window covering material 7 is adjustably positioned in any number of other positions between the fully raised and fully lowered positions. The second rail 5 can also be connected to the lift cord control mechanism to be moved relative to the first rail as the window covering material position is adjusted.

The lift cord control mechanism 10 can be considered a height adjustment mechanism for controlling the raising and lowering of window covering material 7 for at least some embodiments of the window covering 1. The lift cord control mechanism 10 can include a spring motor unit located in the first rail 3. In other embodiments, the lift cord control mechanism 10 can be positioned within the second rail 5.

The lift cord control mechanism 10 can include a first spring motor 10*a* that includes spring motor pulleys 31 and a spring 32 that extends between the spring motor pulleys 31 such that the spring 32 is moveable between these pulleys to adjust an amount of force exerted on a drive shaft 10*c* to maintain a position of the lift cords for maintaining a position of the window covering material 7 at a user selected position. The spring motor pulleys 31 can be mounted within a housing 34 and the spring 32 can be positioned in the cavity of the housing 31. The housing can have at least one hole through which the drive shaft 10*c* is passable for a connection of the drive shaft 10*c* to a spring motor pulley 31.

For instance, a first end of the drive shaft 10*c* can be connected to one of the spring motor pulleys 31 so that rotation of that spring motor pulley in a first rotational direction (e.g. clockwise or counterclockwise direction) drives rotation of the drive shaft 10*c* and rotation of the drive shaft 10*c* in a second rotational direction that is opposite the first rotational direction drives rotation of the spring motor pulley 31. The spring 32 is moved between the spring motor pulleys 31 during rotation of the drive shaft 10*c* in the first rotational direction and also moves in an opposite direction between the spring motor pulleys 31 when the drive shaft 10*c* is rotated in the second rotational direction. In some embodiments, the first end of the drive shaft 10*c* can be connected within a channel or opening defined in the spring motor pulley 31 for providing a mating interlock between the drive shaft 10*c* and the spring motor pulley 31 for such a connection.

Depending on the weight of the window covering material 7, multiple other spring motors could also be provided. For example, a second spring motor 10*b* can be provided as well. The second spring motor 10*b* can be positioned at an opposite end of the first rail 3 from the first spring motor 10*a*. A spring motor pulley 31 of the second spring motor 10*b* can be connected to a second end of the drive shaft 10*c* in a manner similar to how the first spring motor 10*a* can be connected to the first end of the drive shaft 10*c*. In yet other embodiments, the second spring motor 10*b* may be positioned at the same side of the first rail 3 as the first spring motor 10*a* and a portion of the drive shaft 10*c* can pass through a spring motor pulley 31 in each of the spring motors via an interlocking connection between the drive shaft 10*c* and a central channel of spring motor pulleys 31 to provide the coupling of the spring motors to the drive shaft 10*c*.

The window covering material 7 can include slats 7*a* that are supported on ladders 71. The ladders 71 can each include a front rail 72 adjacent a front face of the window covering material and a rear rail 72 adjacent a rear face of the window covering material. Rungs 74 can extend between the front and rear rails 72 to support the slats 7*a*. In some embodiments, there can be a pair of ladders in which one ladder supports a left side of the slats and the other ladder 71 supports a right side of the slats 7*a*. In other embodiments, there may be more than two ladders 71 such that at least one ladder supports a middle portion of the slats 7*a* between the right side and the left side of the slats. The slats 7*a* can be supported on the rungs 74 so that the slats are tiltable from a first closed position in which the slats are in an inclined orientation (e.g. the left and right ends of each slat extends along an angle of about 30-60° relative to horizontal and the rear edge of the slat is lower than the front edge of the slat), an open position in which the slats are in a horizontal orientation (e.g. the front and rear edges of the slats extend horizontally or extend within 5°-10° of being horizontal) and the left and right ends of the slats extend horizontally or extend within 5°-10° of being horizontal), and to a second closed position in which the slats are in a declined orientation (e.g. the left and right ends of each slat extends along an angle of about 30-60° relative to horizontal and the front edge of the slat is lower than the rear edge of the slat). When the slats are in a closed position, a bottom edge of each slat may contact the top edge of an immediately adjacent lower slat or may overlap the top edge of an immediately adjacent lower slat to close a gap that is present between those slats when the slats are in their open position.

The slats 7*a* may be exposed so that the slats are visible to a consumer and affect the aesthetic effect provided by the window covering 1. In some embodiments, the slats 7*a* may be hidden from view or be partially hidden from view. For instance, in some embodiments, the window covering material can also include pleated material, cellular material, fabric material, non-woven fabric material, woven wood, woven bamboo, or other type of material that may enclose or partially enclose the slats 7*a*. For such embodiments, the slats 7*a* may be tiltable to effect how transparent or light-blocking the window covering material 7 may be.

One or more lift cords 4 may extend from at least one pulley that is located within the first rail 3 through the window covering material 7 to connect the window covering material to the lift cord control mechanism 10. In some embodiments, the one or more lift cords 4 may be directly connected to the window covering material. In other embodiments, the one or more lift cords may be pass through the window covering material 7 and also be connected to the second rail 5 and/or pass through the second rail 5 to facilitate a connection of the lift cord control mechanism 10 to the window covering material 7 and the second rail 5.

Some embodiments of the window covering 1 can include a first lift cord 27 and a second lift cord 29. Other embodiments may utilize more than two lift cords (e.g. three lift cords, four lift cords, five lit cords, six lift cords, etc.). Other embodiments, may utilize only one cord that is manipulated via one or more pulleys or other mechanism to route that cord to provide two runs, or lines, to function as multiple lift cords. For such an embodiment, the middle portion of the cord may be coupled to the lift cord control mechanism 10 and the terminal ends of the cord can be connected to different sides or adjacent different ends of the second rail 5 or a lower portion of the window covering material 7. Each lift cord may be a cord, a segment of a cord, a tape, a polymeric filament, or other type of flexible elongated member.

In some embodiments, each lift cord 4 can be collected on and unwound from a respective pulley 12. Each pulley 12 can be connected to the drive shaft 10*c* so that the pulley is operatively connected to the lift cord control mechanism 10 (e.g. first and/or second spring motors 10*a* and 10*b*, etc.). In some embodiments, a first end of the lift cord 4 can be connected to the pulley 12 and the lift cord can extend from the pulley 12 so that the opposite second end of the lift cord can be coupled to a bottommost slat 7 or the second rail 5. For instance, a window covering 1 can include a first lift cord pulley 12*a* and a second lift cord pulley 12*b* that are spaced apart from each other within the first rail 3. The first lift cord 27 can be collected on the first lift cord pulley 12*a* and extend form that pulley through or by the slats 7*a* and to the second rail 5. The second lift cord 29 can be collected on the second lift cord pulley 12*b* and extend form that pulley through or by the slats 7*a* and to the second rail 5.

Each pulley 12 can have a similar structure, or configuration. For example, each pulley 12 can be positioned on or in a mounting element 13 that is attached to or mounted in the first rail 3 such that the pulley 12 is rotatable in opposite rotational directions within the first rail (e.g. is rotatable in a clockwise direction and is also rotatable in a counter clockwise direction). The mounting element 13 can be configured as pulley housing, a pulley carriage or other type of pulley positioning mechanism to facilitate positioning of the pulley within the first rail 3.

Each pulley 12 can have a body that defines an elongated central channel 12*c* that extends from a first end of the body of the pulley to a second end of the body of the pulley that is opposite its first end. The central channel can have openings at its opposite ends defined in opposite ends of the body of the pulley so that the drive shaft 10*c* can extend though the pulley so that rotation of the drive shaft 10*c* cause the pulley 12 to rotate (e.g. the cross section of channel 12*c* can interlock with the cross-sectional shape of the drive shaft 10*c* for engagement between the drive shaft 10*c* and the pulley 12). The opposite ends of the pulley can also be connected to other structures to facilitate coupling to the drive shaft 10*c* and to facilitate coupling to a ladder cord 71 that supports slats 7*a*.

For example, each pulley 12 can be connected to an end connector 14 that has a projection 14*a* for being positioned in an aperture 13*a* (e.g. a slot) of a mounting element 13 to facilitate rotation of the pulley 12 in the first rail 3. The projection 14*a* may have a central channel that is aligned with the central channel 12*c* so that the drive shaft 10*c* can pass through the first end connector 14 and the pulley 12. The mounting element 13 can also include a second aperture 13*b* that is designed to retain a ladder cord connector 16 that has a projection 16*a*. The projection 16*a* of the ladder cord connector 16 can pass through a hole defined in the second aperture 13*b* that is in communication with a cavity that defines a receptacle of the mounting element that is for retaining the ladder cord connector 16. The projection 16*a* of the ladder cord connector 16 can include a central channel that is aligned with the central channel 12*c* of the pulley 12 so that the drive shaft 10*c* can pass through the end connector 14, pulley 12 and the ladder cord connector 16 via the central channel 12*c* and channels within the first connector 14 and the ladder cord connector 16.

The lift cord pulleys 12 and ladder cord connectors 16 can be arranged in a number of different ways within the first rail. In some embodiments, the ladder cord connectors 16 can be connected to ends of respective pulleys 12 so that the projections 16*a* of the ladder cord connectors 16 extend towards each other and the ladder cord connectors are closer to the center of the first rail than the pulleys 12. In other embodiments, the ladder cord connectors 16 can be connected to the pulleys 12 such that the pulleys 12 are located closer to a center of the first rail 3 than the ladder cord connectors 16. In yet other embodiments, a first ladder cord connector can be closer to a center of the first rail 3 than a second ladder cord connector and a first lift cord pulley can be farther from the center of the first rail 3 that a second lift cord pulley.

Each pulley 12 can be connected to a respective ladder cord connector 16 to define a slot 18 in which an upper end of a ladder 71 is positioned. For example, as may best be seen in the enlarged view provided in FIG. 4, the ladder cord connector 16 can be connected to an end of the body of the pulley 12 so that a narrow slot 18 is defined between the pulley 12 and the ladder cord connector 16. The slot 18 can be structured so that an inner portion 18*a* of the slot 18 is narrower than an outer portion 18*b* of the slot 18. An upper end of a ladder cord can connected to the pulley 12 and ladder cord connector 16 via this slot 18. For instance, a top end of a ladder 71 defined by a ladder cord can be looped about the ladder cord connector and positioned in the slot 18 so that front and rear rails 72 of the ladder 71 extend along opposite sides (e.g. front and rear sides) of the slats 7*a* to the second rail 5.

For embodiments that may utilize first and second lift cords 27 and 29 that are each collected on respective first and second lift cord pulleys 12*a* and 12*b*, there may be a first slot 18 defined between a first ladder cord connector 16 attached to an end of the first lift cord pulley 12*a* and a second slot 18 defined between a second ladder cord connector 16 attached to an end of the second lift cord pulley 12*b*. For such embodiments, there may also be a first end connector 14 connected to an end of the first lift cord pulley 12*a* opposite the end that is connected to the first ladder cord connector 16 and a second end connector 14 that is connected to an end of the second lift cord pulley 12*b* opposite the end that is connected to the second ladder cord connector 16.

Embodiments of the window covering that have slats 7*a* supported on ladders 71 that can be configured so that the slats 7*a* are tiltable between open and closed positions in addition to being adjustable between raised and lowered positions, or retracted and extended positions. For instance, the window covering 1 can include slats 7*a* as its window covering material 7 and can have a first ladder 71*a* positioned adjacent a first side of the window covering and a second ladder 71*b* positioned adjacent a second side of the window covering to support the slats that are suspended from the first rail 3 via first and second ladders 71*a* and 71*b* and the lift cords 4. Each of the ladders 71 can have vertically spaced apart rungs 74 that extend between spaced apart front and rear rails 72 of the ladders 71. The font rails 72 of the ladders 71 can extend along affront face of the slats adjacent the front edges of the slats and the rear rails 72 of the ladder can extend along a rear face of the slats adjacent the rear edges of the slats 7*a*.

A slat tilt control mechanism 20 can be operatively connected to the ladders 71 that support the slats to adjust the positions and/or orientations of the rails 72 and rungs 74 of the ladders to facilitate adjustment of the orientation of the slats between the open position and different closed positions. For instance, the slat tilt control mechanism 20 can include a first ladder control mechanism 20*a* and a second ladder control mechanism 20*b* that each include a slot 18 defined between a ladder cord connection pulley 16 attached to a pulley 12. For instance, the first ladder control mechanism 20*a* can include the slot 18 that receives the upper end or top end of the first ladder 71*a* between the ladder cord connector 16 and an end of the first lift cord pulley 12*a* and the second ladder control mechanism 20*b* can include the slot 18 that receives the upper end or top end of the second ladder 71*b* between the ladder cord connector 16 and an end of the second lift cord pulley 12*b*. The ladder control mechanism 20 can be configured to work in conjunction with the lift cord control mechanism 10 so that an adjustment in the orientation of the slats 7*a* and rungs 74 (e.g. tilting or moving from a tilted orientation to a horizontal orientation) occurs automatically and simultaneously with height adjustment of the window covering material 7 (e.g. retraction and extension of the window covering material 7).

The window covering 1 can be configured so that each lift cord has a first portion positioned in the first rail 3, a second portion that passes through the window covering material 7, and a third portion that is positioned in the second rail 5. For example, each of the lift cords can be configured to pass between the front and rear rails 74 of a respective ladder 71 or may pass alongside or adjacent a respective ladder 71 when extending from the first rail 3 to the second rail 5 or a bottom portion of the window covering material (e.g. the bottom most slat). For instance, the first lift cord 27 can have a first segment 27*a* that extends from the first rail 3, through the slats between the front and rear rails 72 of a first ladder 71*a* to the second rail 5. The second lift cord 29 can have a first segment 29*a* that extends from the first rail 3, through the slats between the front and rear rails 72 of a second ladder 71*b* to the second rail 5. As another example, the lift cords can extend from the first rail 3 to the window covering material 7 by passing alongside front or rear edges of the slats adjacent to a front or rear rail of a ladder 71. For such a lift cord route, the lift cords may not pass through any hole within any of the slats or may only pass through a recess or cut-out defined in outer edges of the slats 7*a*.

The lift cords 4 can be passed through the window covering material so that motion of the one or more lift cords can result in retraction or extension of the window covering material 7 to raise or lower the window covering. A user may grasp the window covering material 7, the second rail 5, or a handle connected to the second rail 5 or the window covering material 7 to provide a downward force, or a puling force, that overcomes the biasing force provided by one or more springs 32 that act on the drive shaft 10*c* of the lift cord control mechanism 10 to lower the window covering material 7 and second rail 5. This force provided by the user to lower the window covering drives motion of the lift cords to effect the lowering, or extension, of the window covering material 7 and the lowering of the second rail 5 such that, during lowering of the window covering material, the pulleys 12 may rotate in the second rotational direction so that lift cords 4 are unwound from the pulleys due to the lowering of the window covering material 7, which also drives rotation of the drive shaft 10*c* due to the drive shaft's connection to the pulleys 12. The rotation of the drive shaft 10*c* causes the spring motor pulley(s) to which the drive shaft is attached to rotate in the same second rotational direction as the pulleys 12 and the drive shaft 10*c* such that the spring 32 moves between adjacent spring motor pulleys 31 to which the spring is connected. To raise the window covering material 7 and second rail 5, a user may provide a lifting force, or a pushing force, that is sufficient so that the biasing force of one or more springs 32 of the lift cord control mechanism 10 causes the lift cords to be moved to retract the window covering material 7 and second rail 5. The rotational force can be conveyed via at least one of the springs 32 moving between spring motor pulleys 31 to which it connected so that the spring motor pulley 31 connected to the drive shaft 10*c* rotates in the first rotational direction. The rotation of the drive shaft 10*c* driven by motion of the spring(s) 32 results in the lift cord pulleys 12 rotating in the first rotational direction, which results in the lift cords being wound upon the pulleys 12 for retracting the window covering material 7 and causing the second rail 5 to move closer to the first rail 3. When a user removes the force he or she has provided for raising or lowering the window covering, the lift cord control mechanism 10 can be configured to counterbalance the weight of the window covering material 7 and second rail 5 to prevent rotation of the drive shaft 10*c* (and pulleys 12 connected to the drive shaft 10*c*) to keep the lift cords stationary after the user has removed the applied force to maintain the window covering material 7 and the second rail 5 at the user selected position of the window covering material 7 and the second rail 5.

The pulleys 12 and ladder cord connectors 16 can be configured so that when the window covering material 7 is retracted, the rails 72 of the ladders move to tilt the orientation of the rungs 74 from a horizontal orientation to a declined orientation (or an inclined orientation to a declined orientation) so that the slats 7*a* are in a tilted position so that the window covering material can be moved to a closed position. After the window covering material 7 is moved to a desired position, the slats can be kept in this closed position. If the user desires to have the slat orientation adjusted so that the slats are no longer tilted and the window covering material is in an open position, the user may provide a force to slightly lower, or extend, the window covering material 7. Such a force will cause the pulleys 12 and ladder cord connectors 16 to rotate in an opposite direction so that the rails 72 of the ladders 71 move to change the orientation of the slats 7*a*. When the rails 72 have moved to a position in which the rungs extend horizontally between the rails 72, the slats 7*a* can be in their open positions so that the window covering material 7 is at a desired location and in the open position. The user may then remove the exerted force to keep the window covering material maintained at the desired position and in the open orientation (via the lift cord control mechanism 10 acting on the drive shaft 10*c*). Such a control of the positioning of the slats 7*a* can occur at the same time the window covering material 7 is retracted so that a separate slat tilt control actuator (e.g. a tilt wand) is not needed or used to adjust the slat orientation of the window covering material between their open and closed positions when the window covering material 7 is raised or retracted to a new position.

The pulleys 12 and ladder cord connectors 16 can also be configured so that when the window covering material 7 is extended by a user, the rails 72 of the ladders 71 move to tilt the orientation of the rungs 74 to an inclined orientation. For example, the rails 72 of the ladders can move to tilt the orientation of the rungs 74 from a horizontal orientation or a declined orientation to an inclined orientation so that the slats 7*a* are in a tilted position so that the window covering material can be moved to a closed position as it is extended. After the window covering material 7 is moved to a desired position, the slats can be kept in this closed position. If the user desires to have the slat orientation adjusted so that the slats are no longer tilted and the window covering material is in an open position, the user may provide a force to slightly raise, or retract, the window covering material 7. Such a force will cause the pulleys 12 and ladder cord connectors 16 to rotate in an opposite direction so that the rails 72 of the ladders 71 move to change the orientation of the slats 7*a*. When the rails 72 have moved to a position in which the rungs extend horizontally between the rails 72, the slats 7*a* can be in their open positions so that the window covering material 7 is at a desired location and in the open position. The user may then remove the exerted force to keep the window covering material 7 maintained at the desired position and the slats 7*a* in their open orientation (via the lift cord control mechanism 10 acting on the drive shaft 10*c*). Such a control of the positioning of the slats 7*a* can occur at the same time the window covering material 7 is extended so that a separate slat tilt control actuator (e.g. a tilt wand) is not needed or used to adjust the slat orientation of the window covering material 7 between their open and closed positions during the extension, or lowering of the window covering material 7 to a new position.

During retraction of the window covering material, the rails 72 of the ladders 71 may only move a certain extent and then be kept (or maintained) at their new orientation while the pulleys 12 continue to rotate during widow covering material retraction. The rotational motion of the ladders 71 that is then subsequently stopped while further retraction of window covering material 7 occurs can be provided via the slot 18 and ladder cord connector 16 attachment to the pulley 12 that may be utilized for coupling each ladder 71 to a respective pulley 12. During rotation of the drive shaft 10*c* and pulleys 12, the upper end of the rails 72 may move between the pulley 12 and ladder cord connector 16 to which that ladder 71 is connected so that a rear rail 72 and front rail 72 of the ladder move relative to each other for orientation of the rungs 74 to a tilted position (e.g. inclined or declined orientation). After that initial motion, the rails 72 may be kept in their same tilted orientation as the pulley 12 and ladder cord connector 16 continues to rotate simultaneously with the drive shaft 10*c* due to the upper ends of the rails 72 being integrally connected to define a loop 79 positioned in the slot 18. The upper curved end of this loop 79 defined by the integral connection of the rails 72 may slip within the slot 18 so that the rails 72 extending from the opposite front and rear sides of the slot 18 defined between the ladder cord connector 16 and lift cord pulley 12 and rungs 74 maintain their orientation without the ladder 71 being collected on or unwound from the slot as the pulley 12 and ladder cord connector rotates during retraction.

This same feature an affect the ladders 71 during window covering material extension. For example, during extension of the window covering material, the rails 72 of the ladders 71 may only move a certain extent and then be kept (or maintained) at their new orientation while the pulleys 12 continue to rotate during widow covering material extension. The rotational motion of the ladders 71 that is then subsequently stopped while further extension of window covering material 7 occurs can be provided via the slot 18 and ladder cord connector 16 attachment to the pulley 12 that may be utilized for coupling each ladder 71 to a respective pulley 12. During rotation of the drive shaft 10*c* and pulleys 12, the upper end of the rails 72 for each ladder may move between the pulley 12 and ladder cord connector 16 to which the ladder 71 is connected so that a rear rail 72 and front rail 72 of the ladder 71 move relative to each other for orientation of the rungs 74 of the ladder. After that initial motion, the rails 72 may be kept in their same orientation as the pulley 12 and ladder cord connector 16 to which the ladder 71 is connected continues to rotate simultaneously with the drive shaft 10*c* due to the upper ends of the rails 72 being integrally connected to define the loop 79 positioned in the slot 18. This loop may slip within the slot 18 so that the rails 72 no longer move relative to each other and the rungs 74 maintain their tilted orientation without the ladder 71 being collected on or unwound from the slot 18 as the pulley 12 and ladder cord connector 16 rotates during window covering material extension.

In other embodiments, the limited rotation of the ladders 71 can be provided via a connection that may be defined between the respective mounting element 13 and the ladder cord connector 16 to which a ladder 71 is coupled. The second aperture 13*b* can be configured to limit rotational motion of the ladder cord connector 16 so that it is only able to rotate a limited amount. The ladder cord connector 16 can also be connected to the drive shaft 10*c* and pulley 12 such that the ladder cord connector 16 is able to no longer rotate without affecting the rotational motion of the pulley 12 and drive shaft 10*c*. Such a feature can be provided via a slip-type connection that may be defined between the drive shaft 10*c* and the ladder cord connector 16 (e.g. a resilient interface between the drive shaft 10*c* and the ladder cord connector that permits the drive shaft 10*c* to rotate while the ladder cord pulley 16 that retains the top end of the ladder rails 72 within slot 18 is prevented from rotation via the mounting element 13 to which it is attached or mounted.

Each of the mounting elements 13 can be configured to facilitate the routing of lift cords 4 as they extend from the pulleys 4 to induce friction that affects motion of the lift cords during extension and also during retraction of window covering material. This added friction can help provide an additional amount of force to help provide a more precise amount of window covering material position control via the lift cord control mechanism 10. For example, each mounting element 13 can be configured to include or be attached to a friction inducing member 41 (e.g. a first mounting element 13 can have a first friction inducing member 41 for contacting the first lift cord 27 and a second mounting element can have a second friction inducing member 41 for contacting the second lift cord 29). For each mounting element, the friction inducing member 41 can be attached to the mounting element 13 so that it does not rotate during retraction of window covering material 7 and does not rotate during extension of window covering material. Each friction inducing member 41 can be positioned below a respective one of the lift cord pulleys 12, loop cord connector 16 and slot 18. A lift cord 4 extending from the body of that lift cord pulley 12 can be routed along the non-rotational friction inducting member 41 so that the lift cord contacts the friction inducing member when the lift cord is moved during extension and retraction of window covering material 7 to induce friction. In some embodiments, the lift cord may be routed so that the lift cord encircles the outer periphery (e.g. circumference or perimeter about the width or thickness of the member) of the friction inducing member to define at least one full encirclement 43 about the friction inducting member 41.

The friction provided by the routing of lift cords 4 and the contact the lift cords have with a respective friction inducing member 41 attached to the respective mounting element 13 to which the pulley 12 that the lift cord extends form is attached can help provide a supplemental force that can facilitate maintenance of the position of window covering material at a user desired location. Such friction can also permit smaller and/or weaker springs 32 for spring motor units of the lift cord control mechanism 10 to be utilized to reduce the cost of making window coverings. The routing of the lift cords can also be configured to help keep the lift cord separated from the rails 72 of the ladder 71 connected to the pulley 12 to which the lift cord is attached to avoid hang-up issues that could occur between the rails 72 of the ladder 71 and the lift cord.

It should be appreciated that different embodiments of my window covering can utilize different arrangements to meet a particular set of design criteria. For instance, the window covering material can be any type of suitable material. The first rail 3 can be made of wood, bamboo, metal or other suitable material. The slats 7*a* can be composed of a polymeric material, wood, bamboo, or other type of suitable material. The second rail 5 can be structured as a bottom rail or other type of rail. The first rail 3 can be structured as a headrail or an intermediate rail of a top down bottom up window covering. The type of spring elements used in one or more spring motors of the spring motor unit can be an S-shaped spring or other type of spring. The spring elements can be structured as a constant force spring or variable force spring or have another type of spring member configuration.

As yet another example, it should be appreciated that the ladders 71 can be connected to the lift cord pulley 12 via ladder cord connectors 16 and slots 18 such that the ladders may tilt the rungs in an inclined or declined orientation during retraction of the window covering material 7 and may tilt the rungs on the other tilted orientation during extension (e.g. the rungs may be moved so that the rungs 74 and the slats supported on those rungs are inclined during extension and declined during retraction or may be declined during extension and inclined during retraction). Changing the orientation of the ladder rungs 74 so that they are in a horizontal orientation can be provided by a slight reversal of motion (e.g. a slight retraction after having extended the window covering material or a slight extension after having retracted the window covering material). The slight change in vertical motion may be configured to be very minimal so that the slat orientation adjustment does not significantly change the height of the window covering material via the loop defined by the upper ends of the rails that encircles the pulley 12 and ladder cord connector via slot 18.

It should also be appreciated that some components, features, and/or configurations may be described in connection with only one particular embodiment, but these same components, features, and/or configurations can be applied or used with many other embodiments and should be considered applicable to the other embodiments, unless stated otherwise or unless such a component, feature, and/or configuration is technically impossible to use with the other embodiment. Thus, the components, features, and/or configurations of the various embodiments can be combined together in any manner and such combinations are expressly contemplated and disclosed by this statement. Thus, while certain exemplary embodiments of window covering 1, slat tilt control mechanism, and methods of making and using the same have been shown and described above, it is to be distinctly understood that the invention is not limited thereto but may be otherwise variously embodied and practiced within the scope of the following claims.

What is claimed is:

1. A window covering comprising:

a first rail;

window covering material comprising a plurality of slats being moveable relative to the first rail;

a lift cord control mechanism positioned in the first rail, the lift cord control mechanism having a drive shaft that extends within the first rail;

a first lift cord pulley connected to the drive shaft such that rotation of the drive shaft in a first rotational direction causes the first lift cord pulley to rotate in the first rotational direction and rotation of the first lift cord pulley in a second rotational direction that is opposite the first rotational direction causes the drive shaft to rotate in the second rotational direction;

a first ladder cord connector connected to a first end of the first lift cord pulley to define a first slot between the first ladder cord connector and the first lift cord pulley;

a first ladder having a front rail, a rear rail, and rungs extending between the front rail and the rear rail, each of the rungs of the first ladder supporting a respective one of the slats, the front rail being moveable relative to the rear rail to adjust an orientation of the rungs between tilted orientations and a horizontal orientation, an upper end of the first ladder being defined by a connection between an upper end of the front rail and an upper end of the rear rail, the upper end of the first ladder being positioned in the first slot between the first ladder cord connector and the first lift cord pulley so that rotation of the drive shaft in the first rotational direction moves the first ladder so that the rungs are moveable into a first tilted orientation for tilting of the slats and rotation of the drive shaft in the second rotational direction moves the first ladder so that the rungs are moveable into a second tilted orientation for tilting of the slats; and a first lift cord extending from the first lift cord pulley to a positioned adjacent a bottom-most slat of the slats supported by a bottommost rung of the rungs of the first ladder; the first lift cord connected to the first lift cord pulley such that rotation of the first lift cord pulley in the first rotational direction winds the first lift cord about the first lift cord pulley to facilitate retraction of the window covering material and rotation of the first lift cord pulley in the second rotational direction unwinds the first lift cord from the first lift cord pulley to facilitate extension of the window covering material; material;

a first mounting element positioned in the first rail to facilitate rotatable positioning of the first lift cord pulley within the first rail;

a first end connector positioned adjacent to a second end of the first lift cord pulley, the first end connector having a first projection extending away from the first lift cord pulley, the first projection of the first end connector positioned in a first aperture of the first mounting element, a first projection of the first ladder cord connector extending away from the first lift cord pulley positioned in a second aperture of the first mounting element, the second aperture of the first mounting element in communication with a cavity that defines a receptacle of the first mounting element that retains the first ladder cord connector;

the first end connector having a channel aligned with an elongated channel of the first lift cord pulley and a channel of the first projection of the first ladder cord connector, the drive shaft passing through the channel of the first end connector, the elongated channel of the first lift cord pulley, and the channel of the first projection of the first ladder cord connector;

a first friction inducing member being attached to the first mounting element so that the first friction inducing member is not rotatable and is positioned below the first ladder cord connector, the first lift cord contacting the first friction inducing member such that the first lift cord is routed along the first friction inducing member such that the first lift cord defines at least one full encirclement about the first friction inducing member in which the first lift cord fully encircles a circumference of the first friction inducing member.

2. The window covering of claim 1, wherein:

the first lift cord is collectable on a body of the first lift cord pulley between the first end connector and the first ladder cord connector via rotation of the first lift cord pulley in the first rotational direction.

3. The window covering of claim 1, wherein the first rotational direction is clockwise and the second rotational direction is counterclockwise.

4. The window covering of claim 1, wherein the first rotational direction is counterclockwise and the second rotational direction is clockwise.

5. The window covering of claim 1, comprising:

a second rail, the first lift cord connected to the second rail adjacent to the bottom-most rung and the bottom-most slat.

6. The window covering of claim 5, wherein the first rail is a headrail and the second rail is a bottom rail.

7. The window covering of claim 1, wherein the drive shaft extends through the first lift cord pulley and through the first ladder cord connector.

8. The window covering of claim 7, wherein the elongated channel of the first lift cord pulley is a central channel.

9. The window covering of claim 8, wherein the drive shaft is interlocked to the first lift cord pulley and the first ladder cord connector.

10. The window covering of claim 1, wherein the lift cord control mechanism also comprises:

a first spring motor comprising a first spring motor pulley, a second spring motor pulley and a spring extending between the first spring motor pulley and the second spring motor pulley, the drive shaft being connected to the first spring motor pulley.

11. The window covering of claim 10, wherein the spring is configured to bias the first spring motor pulley to rotate in the first rotational direction.

12. The window covering of claim 1, wherein the circumference is a perimeter about a width or thickness of the first friction inducing member.

13. The window covering of claim 12, wherein the first ladder cord connector is closer to a center of the first rail than the first lift cord pulley.

14. A method of adjusting a window covering comprising:

providing a window covering comprising:

a first rail;

window covering material comprising a plurality of slats being moveable relative to the first rail;

a lift cord control mechanism positioned in the first rail, the lift cord control mechanism having a drive shaft that extends within the first rail;

a first lift cord pulley connected to the drive shaft such that rotation of the drive shaft in a first rotational direction causes the first lift cord pulley to rotate in the first rotational direction and rotation of the first lift cord pulley in a second rotational direction that is opposite the first rotational direction causes the drive shaft to rotate in the second rotational direction;

a first ladder cord connector connected to a first end of the first lift cord pulley to define a first slot between the first ladder cord connector and the first lift cord pulley;

a first ladder having a front rail, a rear rail, and rungs extending between the front rail and the rear rail, each of the rungs of the first ladder supporting a respective one of the slats, the front rail being moveable relative to the rear rail to adjust an orientation of the rungs between tilted orientations and a horizontal orientation, an upper end of the first ladder being defined by a connection between an upper end of the front rail and an upper end of the rear rail, the upper end of the first ladder being positioned in the first slot between the first ladder cord connector and the first lift cord pulley so that rotation of the drive shaft in the first rotational direction moves the first ladder so that the rungs are moveable into a first tilted orientation for tilting of the slats and rotation of the drive shaft in the second rotational direction moves the first ladder so that the rungs are moveable into a second tilted orientation for tilting of the slats;

a first lift cord extending from the first lift cord pulley to a positioned adjacent a bottom-most slat of the slats supported by a bottommost rung of the rungs of the first ladder; the first lift cord connected to the first lift cord pulley such that rotation of the first lift cord pulley in the first rotational direction winds the first lift cord about the first lift cord pulley to facilitate retraction of the window covering material and rotation of the first lift cord pulley in the second rotational direction unwinds the first lift cord from the first lift cord pulley to facilitate extension of the window covering material;

a first mounting element positioned in the first rail to facilitate rotatable positioning of the first lift cord pulley within the first rail;

a first end connector positioned adjacent to a second end of the first lift cord pulley, the first end connector having a first projection extending away from the first lift cord pulley, the first projection of the first end connector positioned in a first aperture of the first mounting element, a first projection of the first ladder cord connector extending away from the first lift cord pulley positioned in a second aperture of the first mounting element, the second aperture of the first mounting element in communication with a cavity that defines a receptacle of the first mounting element that retains the first ladder cord connector;

the first end connector having a channel aligned with an elongated channel of the first lift cord pulley and a channel of the first projection of the first ladder cord connector, the drive shaft passing through the channel of the first end connector, the elongated channel of the first lift cord pulley, and the channel of the first projection of the first ladder cord connector; and a first friction inducing member being attached to the first mounting element so that the first friction inducing member is not rotatable and is positioned below the first ladder cord connector, the first lift cord contacting the first friction inducing member such that the first lift cord is routed along the first friction inducing member such that the first lift cord defines at least one full encirclement about the first friction inducing member in which the first lift cord fully encircles a circumference of the first friction inducing member;

providing a force to extend the window covering material so that the first lift cord is unwound from the first lift cord pulley and the first lift cord pulley rotates in the second rotational direction so that the drive shaft rotates in the second rotational direction and the rungs of the ladder are tilted so that the rungs are in the second tilted orientation;

after the providing of the force to extend the window covering material, providing a force to retract the window covering material until the rungs are in the horizontal orientation.

15. The method of claim 14, wherein the force that is provided to retract the window covering material is a lifting force and the force that is provided to extend the window covering material is a lowering force.

16. The method of claim 14, wherein the window covering material is pulled to provide the force to extend the window covering material.

17. The method of claim 14, wherein the window covering material is pushed to provide the force to retract the window covering material, a spring motor of the lift cord control mechanism rotating the drive shaft to rotate in the first rotational direction in response to the force that is provided to rotate the lift cord pulley in the first rotational direction to retract the window covering material.

18. A window covering comprising:

a first rail;

window covering material comprising a plurality of slats being moveable relative to the first rail;

a second rail below the window covering material;

a lift cord control mechanism positioned in the first rail, the lift cord control mechanism having a rotatable drive shaft within the first rail;

a first lift cord pulley connected to the drive shaft such that rotation of the drive shaft in a first rotational direction causes the first lift cord pulley to rotate in the first rotational direction and rotation of the first lift cord pulley in a second rotational direction that is opposite the first rotational direction causes the drive shaft to rotate in the second rotational direction;

a first ladder cord connector connected to a first end of the first lift cord pulley to define a first slot between the first ladder cord connector and the first lift cord pulley;

a first ladder having a front rail, a rear rail, and rungs extending between the front rail and the rear rail, each of the rungs of the first ladder supporting a respective one of the slats adjacent a first side of the slats, the front rail being moveable relative to the rear rail to adjust an orientation of the rungs between tilted orientations and a horizontal orientation, an upper end of the first ladder being defined by a connection between an upper end of the front rail and an upper end of the rear rail, the upper end of the first ladder being positioned in the first slot between the first ladder cord connector and the first lift cord pulley so that rotation of the drive shaft in the first rotational direction moves the first ladder so that the rungs are moveable into a first tilted orientation for tilting of the slats and rotation of the drive shaft in the second rotational direction moves the first ladder so that the rungs are moveable into a second tilted orientation for tilting of the slats; and a first lift cord extending from the first lift cord pulley to a positioned adjacent a bottom-most slat of the slats supported by a bottommost rung of the rungs of the first ladder; the first lift cord connected to the first lift cord pulley such that rotation of the first lift cord pulley in the first rotational direction winds the first lift cord about the first lift cord pulley to facilitate retraction of the window covering material and rotation of the first lift cord pulley in the second rotational direction unwinds the first lift cord from the first lift cord pulley to facilitate extension of the window covering material;

a second lift cord pulley connected to the drive shaft such that rotation of the drive shaft in a first rotational direction causes the second lift cord pulley to rotate in the first rotational direction and rotation of the second lift cord pulley in a second rotational direction that is opposite the first rotational direction causes the drive shaft to rotate in the second rotational direction;

a second ladder cord connector connected to a first end of the second lift cord pulley to define a second slot between the second ladder cord connector and the second lift cord pulley;

a second ladder having a front rail, a rear rail, and rungs extending between front and rear rails, each of the rungs of the second ladder supporting a respective one of the slats adjacent a second side of the slats, the front rail being moveable relative to the rear rail to adjust an orientation of the rungs between tilted orientations and a horizontal orientation, an upper end of the second ladder being defined by a connection between an upper end of the front rail and an upper end of the rear rail, the upper end of the second ladder being positioned in the second slot between the second ladder cord connector and the second lift cord pulley so that rotation of the drive shaft in the first rotational direction moves the second ladder so that the rungs are moveable into a first tilted orientation for tilting of the slats and rotation of the drive shaft in the second rotational direction moves the second ladder so that the rungs are moveable into a second tilted orientation for tilting of the slats; and a second lift cord extending from the second lift cord pulley to a positioned adjacent a bottom-most slat of the slats supported by a bottommost rung of the rungs of the second ladder;

the second lift cord connected to the second lift cord pulley such that rotation of the second lift cord pulley in the first rotational direction winds the second lift cord about the second lift cord pulley to facilitate retraction of the window covering material and rotation of the second lift cord pulley in the second rotational direction unwinds the second lift cord from the second lift cord pulley to facilitate extension of the window covering material;

a first mounting element positioned in the first rail to facilitate rotatable positioning of the first lift cord pulley within the first rail;

a first end connector positioned adjacent to a second end of the first lift cord pulley, the first end connector having a first projection extending away from the first lift cord pulley, the first projection of the first end connector positioned in a first aperture of the first mounting element, a first projection of the first ladder cord connector extending away from the first lift cord pulley positioned in a second aperture of the first mounting element, the second aperture of the first mounting element in communication with a cavity that defines a receptacle of the mounting element that retains the first ladder cord connector;

the first end connector having a channel aligned with an elongated channel of the first lift cord pulley and a channel of the first projection of the first ladder cord connector, the drive shaft passing through the channel of the first end connector, the elongated channel of the first lift cord pulley, and the channel of the first projection of the first ladder cord connector;

a first friction inducing member being attached to the mounting element so that the first friction inducing member is not rotatable and is positioned below the first ladder cord connector, the first lift cord contacting the first friction inducing member such that the first lift cord is routed along the first friction inducing member such that the first lift cord defines at least one full encirclement about the first friction inducing member in which the first lift cord fully encircles a circumference of the first friction inducing member;

a second mounting element positioned in the first rail to facilitate rotatable positioning of the second lift cord pulley within the first rail;

a second end connector positioned adjacent to a second end of the second lift cord pulley, the second end connector having a first projection extending away from the second lift cord pulley, the first projection of the second end connector positioned in a first aperture of the second mounting element, a first projection of the second ladder cord connector extending away from the second lift cord pulley positioned in a second aperture of the second mounting element, the second aperture of the second mounting element in communication with a cavity that defines a receptacle of the second mounting element that retains the second ladder cord connector;

the second end connector having a channel aligned with an elongated channel of the second lift cord pulley and a channel of the second projection of the second ladder cord connector, the drive shaft passing through the channel of the second end connector, the elongated channel of the second lift cord pulley, and the channel of the second projection of the second ladder cord connector;

a second friction inducing member being attached to the second mounting element so that the second friction inducing member is not rotatable and is positioned below the second ladder cord connector, the second lift cord contacting the second friction inducing member such that the second lift cord is routed along the second friction inducing member such that the second lift cord defines at least one full encirclement about the second friction inducing member in which the second lift cord fully encircles a circumference of the second friction inducing member.

19. The window covering of claim 18, wherein the first ladder cord connector is closer to a center of the first rail than the first lift cord pulley and the second ladder cord connector is closer to the center of the first rail than the second lift cord pulley.

20. The window covering of claim 19, wherein the first lift cord pulley is closer to a center of the first rail than the first ladder cord connector and the second lift cord pulley is closer to the center of the first rail than the second ladder cord connector.

* * * * *